United States Patent [19]

Hall

[11] 4,281,716

[45] Aug. 4, 1981

[54] FLEXIBLE WORKOVER RISER SYSTEM

[75] Inventor: Johnce E. Hall, Kingwood, Tex.

[73] Assignee: Standard Oil Company (Indiana), Chicago, Ill.

[21] Appl. No.: 65,793

[22] Filed: Aug. 13, 1979

[51] Int. Cl.[3] ..... E21B 34/04

[52] U.S. Cl. ..... 166/339; 166/362; 166/366

[58] Field of Search ..... 166/339, 344, 352, 355, 166/362, 366-368; 175/7

[56] References Cited

U.S. PATENT DOCUMENTS

| | | | |
|---|---|---|---|
| 3,421,581 | 1/1969 | Van Geijn | 166/355 |
| 3,516,488 | 6/1970 | Joubert et al. | 175/7 X |
| 3,602,302 | 8/1971 | Kluth | 166/352 |
| 3,789,921 | 2/1974 | DeChassy et al. | 166/366 |

*Primary Examiner*—Ernest R. Purser
*Assistant Examiner*—Richard E. Favreau
*Attorney, Agent, or Firm*—John D. Gassett

[57] ABSTRACT

This describes a method of performing operations in a well selected from a group or cluster of subsea wells which are produced through a production riser means to production facilities on a floating platform. There is provided a flexible workover riser on the platform which extends through a passage on the platform at a location remote from the moon pool for the production riser means. The flexible workover riser is run through said passage and guided into connection with the production tubing in the subsea well. Wireline or other well operations are then conducted through the connected flexible workover riser from the floating platform.

7 Claims, 7 Drawing Figures

FLEXIBLE WORKOVER RISER SYSTEM

BRIEF SUMMARY OF THE INVENTION

This invention concerns a method and apparatus for "working over" a selected subsea well from a production facility on a platform floating over a cluster of subsea wells which are produced through a production riser to such production facility. As is well known, there are a variety of methods for producing wells drilled in the ocean floor. One such method, and to which this present invention relates, involves drilling a plurality of wells in the ocean floor from a relativley small aerial spot, each of such wells is provided with normally what is called a wet tree or wellhead which includes various flow lines, guides and control valves. Such wellheads are normally located sufficiently close together so that they can be drilled from a floating vessel while anchored in essentially the same location. These wells are directionally drilled so that they can drain a considerably large area. For purposes herein, the term "seafloor well group" will include those wells which are grouped tightly together on one template and/or nearby satellite wells which are drilled from the floating vessel while anchored in substantially the same position.

One form of producing these wells is to provide a production facility over the seafloor well group which may include what is called a cluster and/or nearby satellite subsea Christmas tree wellheads. Suspended from this production facility is a production riser. The production riser is in reality a plurality of production tubings and control lines so that production can be obtained from each of the wells in the seafloor well group. The production riser extends up through a vertical opening, called a moon pool, in the ship or vessel supporting the production facilities. Some of the wells in the seafloor well group will need occasional workover maintenance and logging. Through the flow line tool or pump down tool (TFL/PDT) can be used on some of these wells. However, in many cases it will be necessary to use procedures whereby wireline type entries into the wellhead tubing is mandatory. The present method discloses a system for performing such workovers making wireline type entries into the wellhead tubing without disrupting the production from the other wells in the seafloor well group. I cut a vertical, flexible workover riser passage through the vessel carrying the production facilities at a location remote from the production moon pool. A flexible workover riser is then run through such passage after guidelines have been established between such passage and the well needing the workover. I then obtain access to said selected subsea well and connect the flexible workover riser to the subsea well. Production from the selected well is closed off and entry is made into the tubing directly through these flexible workover risers to conduct whatever workover or wireline supported activity necessary. My flexible workover riser can be used on satellite subsea wells by positioning a floating platform or vessel supporting the workover riser over such satellite well, reeling out the flexible riser and connecting it to the subsea well and performing workover operations.

A better understanding of the invention can be had from the following description taken in conjunction with the drawings.

DRAWINGS

DETAILED DESCRIPTION

Figure 1:
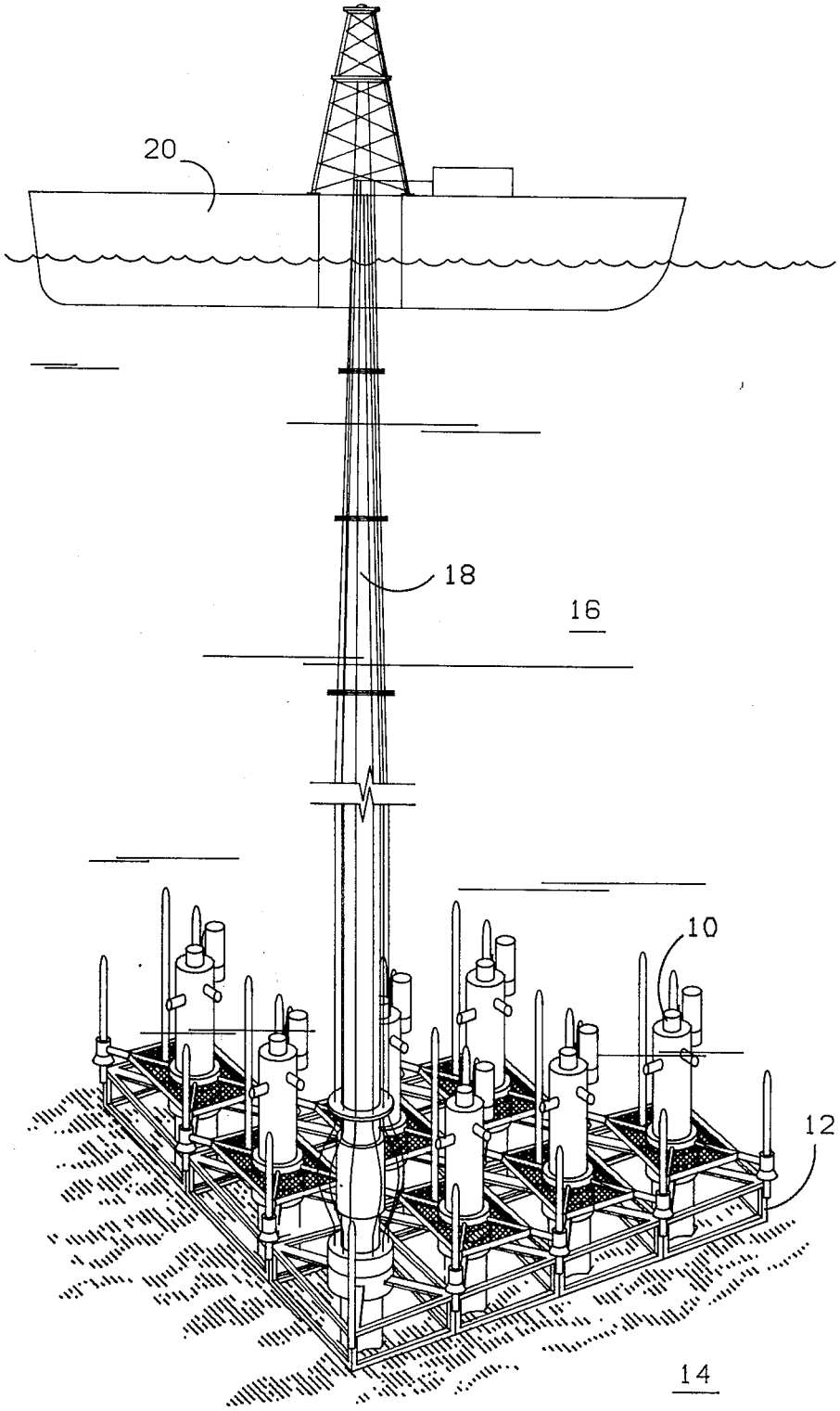
FIG. 1 illustrates a cluster of subsea wells producing through a production riser to a floating production station.

Attention is first directed to FIG. 1 which shows a typical arrangement for connecting subsea production to a floating production station. Shown thereon are a plurality of subsea well trees 10 spaced about a subsea template 12 positioned on the bottom 14 of the body of water 16. Each subsea well tree 10 can be like the one illustrated in FIG. 3 which will be discussed later. Production flow lines are provided for each well 10 to production riser 18 to the floating production station 20. Thus with the system of FIG. 1, production can be obtained from each of the wells 10 independently and conveyed through production riser 18 to the producing facilities 20.

Figure 2:
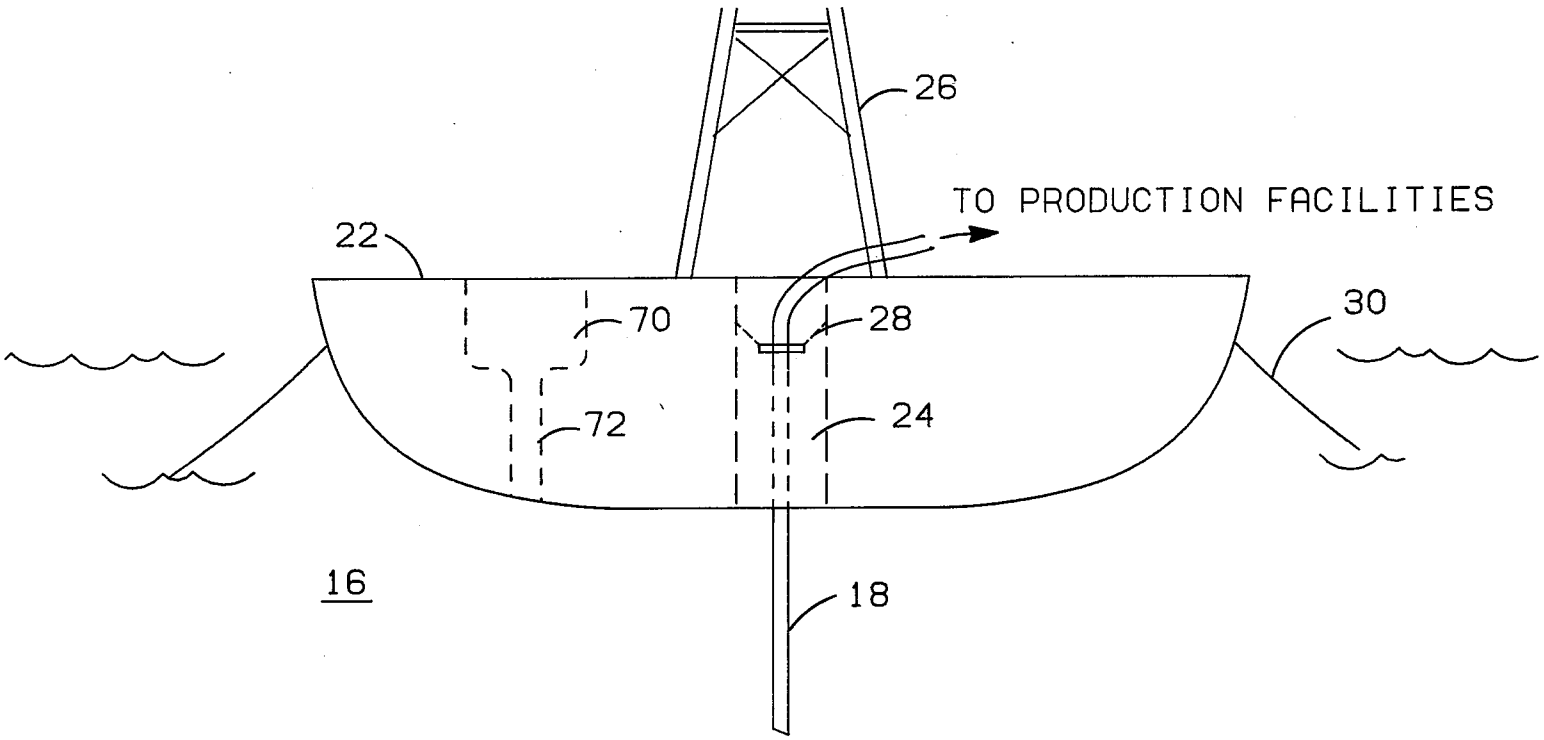
FIG. 2 illustrates the production riser in the production moon pool of a floating vessel and the location with respect to the moon pool of a flexible riser passage.

Attention is next directed to FIG. 2 which shows a vessel upon which the producing facility is located. As illustrated, this floating platform is a vessel 22 having a production moon pool 24 through which the production riser 18 extends. A rig 26 is mounted over the production moon pool 24 for use in running or pulling the production riser 18. Constant tensioning means 28 are provided between the production riser 18 and the vessel 22. Vessel 22 is held on location by conventional means such as anchor lines 30.

Figure 3:
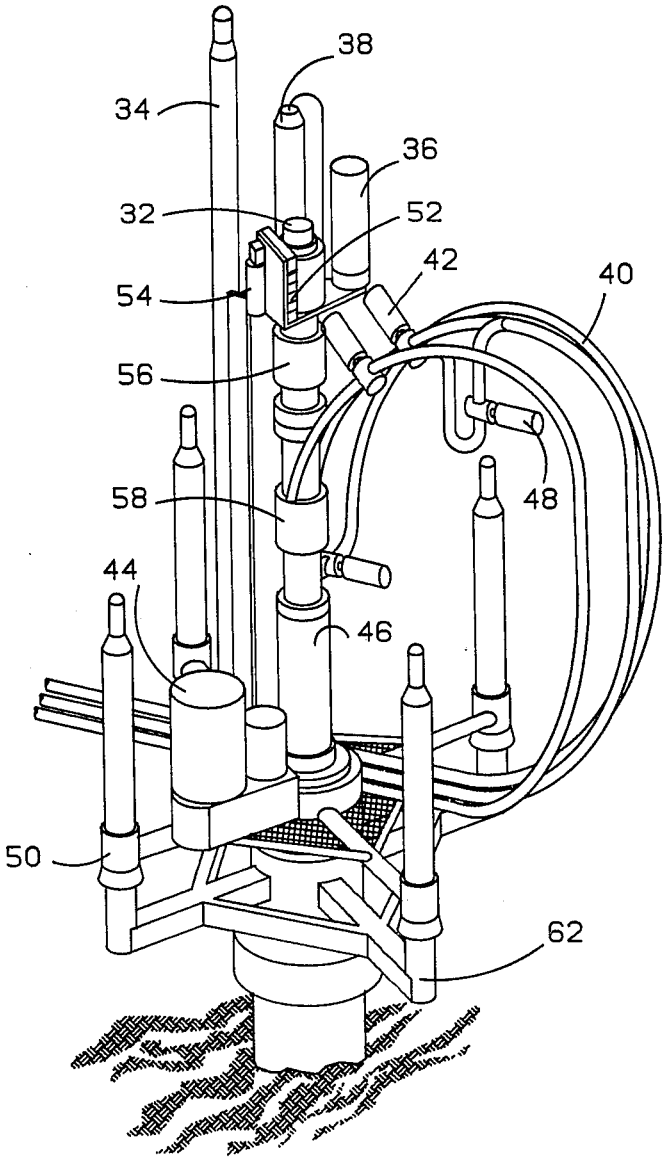
FIG. 3 illustrates a typical, commercially available, single well wet tree.

Attention is next directed to FIG. 3 which illustrates a single well wet tree. The wells of FIG. 1 can be equipped with this type tree. This tree of FIG. 3 and the subsea production arrangement including the production riser 18 of FIG. 1 are commercially available from Vetco Offshore Group, 250 West Stanley, Ventura, Calif. 93001. The wet tree of FIG. 3 is provided with a tree cap 32, entry post 34, recall buoy 36, buoy post 38, flow line loops 40, wing valve 42, control pod 44, master valve 46, crossover valve 48, tree guide frame 50, shuttle valve 52, sequence valve 54, swab valve 56, and wye spool 58.

One of the major problems in using the facilities as described in conjunction with FIG. 1 and FIG. 3 is on those occasions when it is necessary to make wireline entry into the tubing in the wellbore of wells 10. One way of accomplishing this, which has been suggested, is to simply shut in all the wells and using rig 26 pull production riser 18. By pulling it, one would simply raise the bundle and remove it section by section. Once the production riser pipe is completely raised, a workover riser pipe could then be run by rig 26 to the selected well 10 requiring the wireline operation. This is a rather impractical method because of two factors. In the first place, it requires production from all of the wells to be stopped. Secondly, it is very time consuming.

Figure 4:
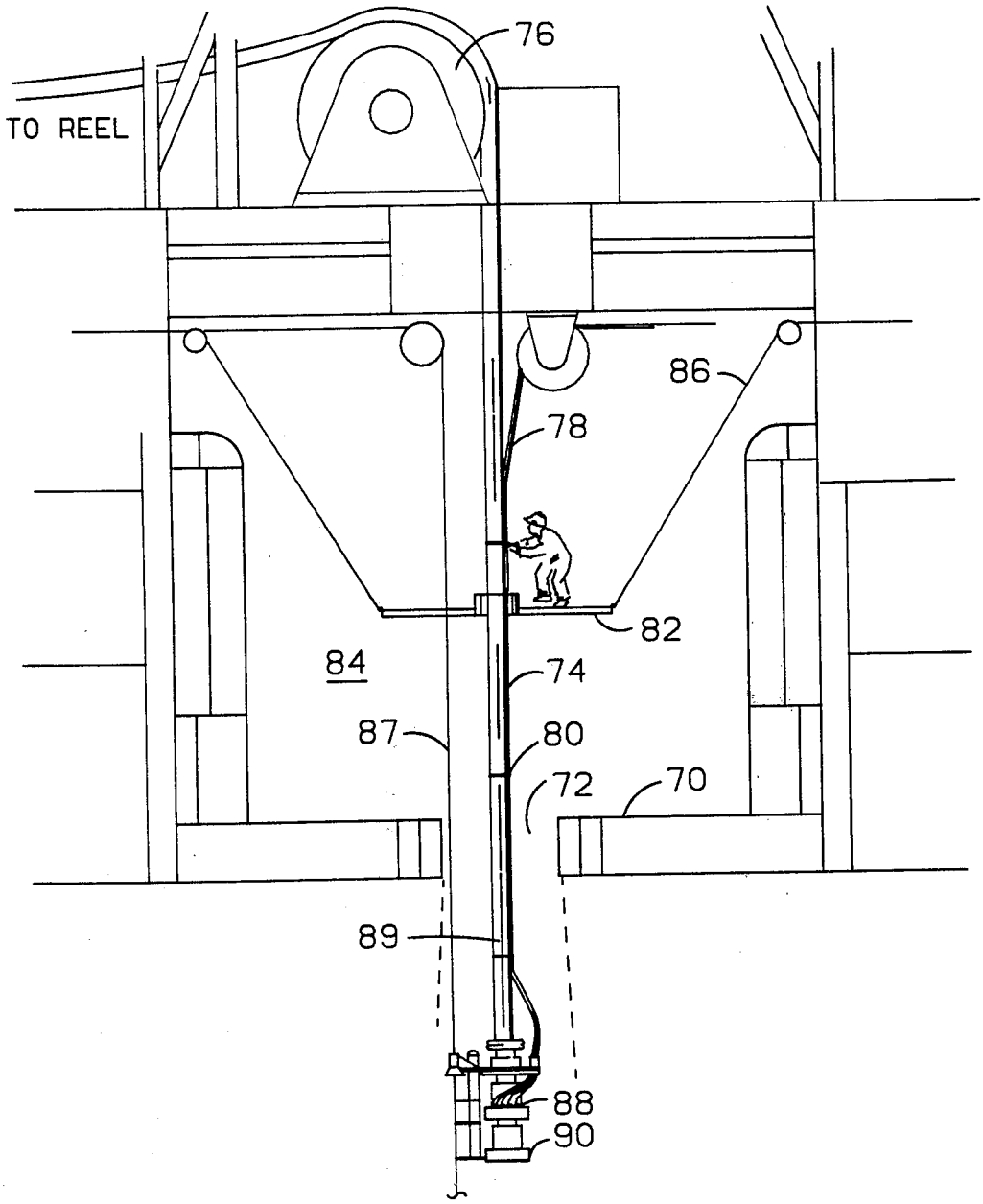
FIG. 4 illustrates the running of the flexible workover riser of this invention through a specially prepared opening in the ship.

Attention is directed to FIG. 2 which illustrates a modification to the vessel 22 used in my invention. This illustrates a production work deck 70 shown by dotted lines and a vertical passage 72 which are removed, for example by at least about 30 feet, from production moon pool 24. Attention is next directed to FIG. 4 which illustrates the modification of vessel 22 for running a workover riser. Shown thereon is deck 70 having a vertical passage 72 therethrough which opens into the water 16 (not shown in FIG. 4). Shown thereon is a workover riser 74 which is flexible and can be a Coflexip flexible pipe which is commercially available from Coflexip and Services, Inc., 4242 S.W. Freeway, Houston, Tex. 77027. This extends over a sheave 76 and extends to a reel not shown. A control hose bundle 78 is attached by clamps 80 to workover riser 74 as it is lowered. A platform 82 is provided within a protected enclosed work space 84 and is provided with lines 86 which lead to tensioners not shown. The work platform 82 can be relativey small, e.g., 8'×8'. A guideline 87 is provided which is used to guide the flexible workover riser to the selected subsea well. The lower end of the workover riser 74 is provided with a tree running tool 88 and a tree cap assembly 90 both of which are commercially available. Cap assembly 90 includes three vertical tubing extensions at the top thereof. A first extension is identified as a production tubing extension 75 and connects to workover riser 74. The other two extensions 77 can be for connections to other tubing or to the subsea well annulus. The flexible riser can be handled and run without use of the on board rig.

When using my method, the production riser 18 is run through the production moon pool area and remains there during normal production operation. Since the production riser remains in the normal moon pool area, there is no need for extensive modification of the spider deck. Further, my system permits production to be run through the production riser at all times, and there is no need to shut in the other wells in the seafloor well group during workover operations. Therefore, conversion requirements from a drilling vessel to a production facility are held to a minimum.

My method permits the workover riser to be run without shutting in production from the remaining wells and without pulling the production riser. The production riser and the workover riser should normally be separated by at least 30 feet or more at the production facility in order to avoid collision between the two risers from dynamic action. This separation, of course, precludes the use of the rig 26 to handle and run the workover riser. I solved this problem by using a flexible pipe stored on a reel as described above. Since the water depth is constant, the required amount of flexible pipe would remain fixed. Steel pipe is added to the ends to make up the differences in length due to variable vessel offsets and well locations on the bottom of the body of water. The lower section 89 of the flexible riser pipe 74 can be made of steel to serve as a terminator to allow a smooth transition of alignment between the flexible workover riser and the tree tubing ports.

Figure 5:
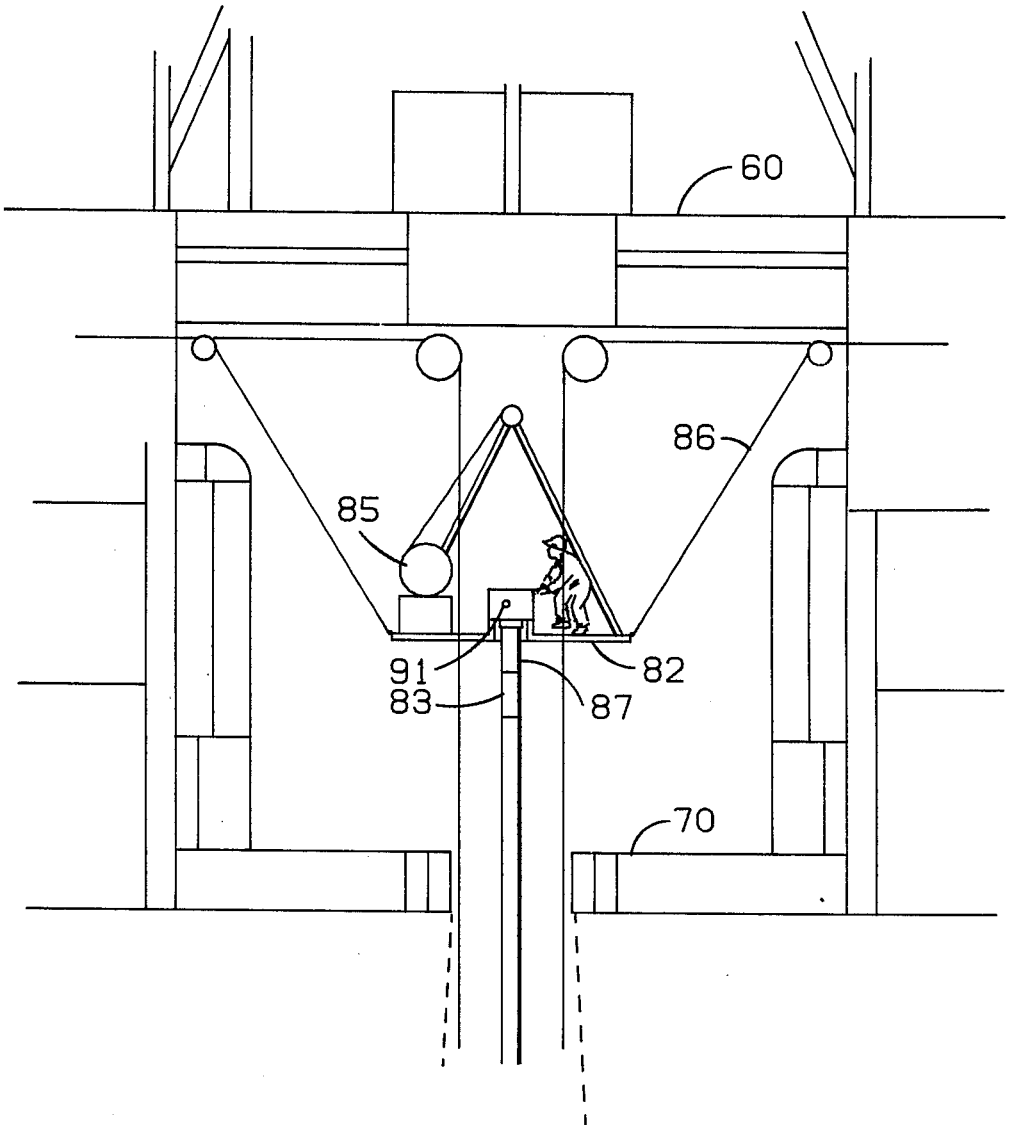
FIG. 5 illustrates the upper end of a flexible workover riser with wireline tool facilities.

As shown in FIG. 5, the upper end of the workover riser is supported by a heave compensated work platform 82. Before landing the workover onto the work platform, a suitable steel pupjoint 83 is added to the upper end of the flexible riser to give appropriate overall riser length and to allow the work platform to be situated half way between the Texas deck 60 and the spider deck 70 which is merely a sub deck. The workover platform 82 is of sufficient size to support a wireline with its assembly 85 thereon. A conventional lubricator 87 is provided on top of steel section 83. A packing cap 89 is proviced just above the work deck 82 on the workover riser. The slot in the cellar deck and the overhead ceiling can be very small. Therefore, modifications of the vessel and space requirements are minimal. Moreover, the work platform area can be situated anywhere in the cellar deck area, provided it is not anywhere near the production riser. There should not be severe limitations since it would probably be difficult to get within 30 feet of the production riser due to the many production lines involved.

The above describes the general concept of the flexible workover riser method of my invention. I will now give a sequence of events to provide better understanding of the method of operation.

1. A guideline will first be established from the Christmas tree of the selected well to the surface. This can be done in a conventional manner such as by releasing recall buoy 36 by hydraulic or acoustic command from the surface. This permits the operator to re-establish contact with the tree from the surface. A messenger line from recall buoy 36 provides the means to re-establish initial re-entry guidelines on the tree. A re-entry funnel (such as commercially available from Vetco supra) may be used to establish the heavier re-entry guidelines on the re-entry post 34 and to install the guidelines on post of the permanent guide structure 62. The internal cam of the re-entry funnel indexes on a mating key on the post 34 to rotationally orient the funnel assembly. Other means of establishing guidelines can be used.

2. A tree running tool which is commercially available from Vetco is next connected to the end of the flexible workover riser and is lowered to retrieve the cover of the treecap as illustrated in FIG. 3. A control hose bundle is strapped to the flexible workover riser during running of this assembly to establish a communication length between the wet tree of FIG. 3 and the surface.

Figure 6:
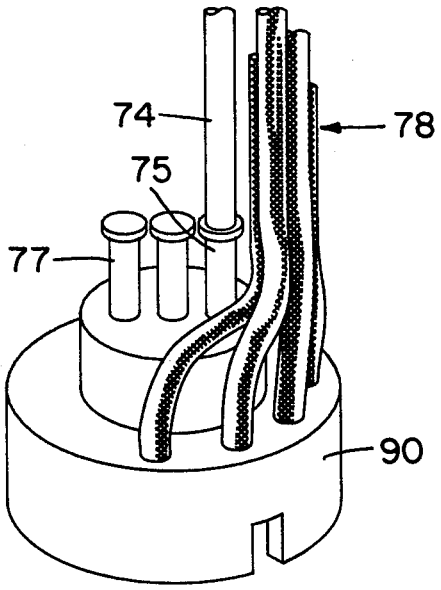
FIG. 6 illustrates a workover subassembly for attaching to the lower end of the flexible workover riser.

3. After the cover of the treecap assembly is removed, the flexible workover riser with control bundle is once again run with a tree workover subassembly as illustrated in FIG. 6. A tree workover subassembly is commercially available from Vetco. The workover subassembly is oriented over the uncovered treecap. This orientation may be accomplished by using a re-entry funnel. Any tubing string can be entered by selectively attaching the workover riser to the appropriate tubing port exiting from the workover subassembly. The workover subassembly also contains hydraulic stabs which mate with the tree manifold ports to supply hydraulic power for all lock/unlock and open/close functions on the subsea tree.

4. Before the workover subassembly is locked onto the subsea tree, a steel section is added to the upper end of the flexible riser which is used to make up the difference in overall riser length as may be required by vessel offset and/or well location on the bottom. The overall length of the workover riser is selected such that the workover platform is centered between the cellar deck 70 and its overhead ceiling.

Figure 7:
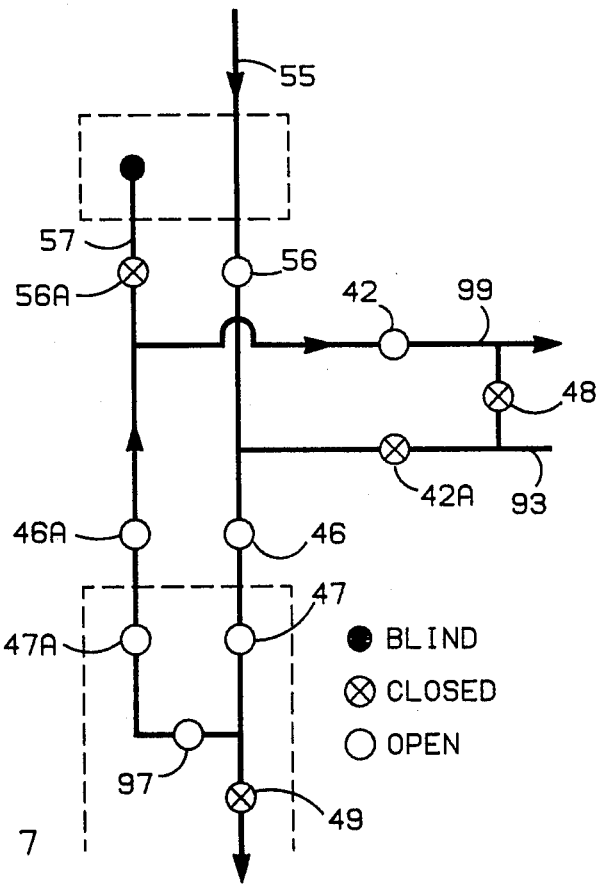
FIG. 7 illustrates service and flow line arrangement with valves.

5. After the workover subassembly and control bundle stabs are locked into place and the upper end of the workover riser 74 is supported from the workover platform by constant tensioners, two modes of workover are then possible: (a) wireline and (b) pump down.

a. In the wireline mode, a wireline winch 85 can be mounted onto the work platform as shown in FIG. 5. The upper end of the workover riser can be made to serve as a lubricator. During loading/unloading of the tools in the lubricator, the tree swab valve is closed via the other control bundle running along the workover riser. After the tools are inserted and the packing cap 91 is fixed to the top of the lubricator, the swab valve 56 can be opened. Production need not necessarily be shut-in during launching of tools, although for safety reasons it may be desirable to shut the wing valve 42A during this operation. A line diagram of these valves and associated lines are illustrated in FIG. 7 which illustrates certain valves closed while others are shown open. However, these valves can be opened and closed remotely. Line 55 provides vertical access to the selected well tubing and line 57 provides vertical access to the service line in the well. Line 55 has swab valve 56, master valve 46, downhole safety valve 47 and standing valve 49. Line 57 has swab valve 56A, master valve 46A and downhole safety valve 47A. A circulating control valve 97 is in the loop between lines 55 and 57. Production line 93 has wing valve 42A and service line 99 has wing valve 42. A cross-over valve 48 is in the loop between lines 93 and 99. While the tools are downhole, the well can be circulated through the production riser by opening the wing valve 42 of service line 99 and closing valve 42A of production line 93. It is to be remembered that the production riser assembly in my system is still in operation.

b. In the pump down mode, the production string and service line can be purged for pump down service via the valve arrangement shown in FIG. 7. In this case, the working fluid is pumped down the workover riser 74 through the circulating control valve (CCV) 97 (which is downhole in the usual manner) up the service line 99 and out through the production riser bundle (the service line 99 is a part of the production riser bundle). In this case valves 46, 46A, 47, 47A and 97 are open. Valves 47A and 47 are safety valves and valve 49 is a standing valve.

When pump down tools are used in my system, they are launched in the workover riser similar to the wireline operation. Since these tools travel in the workover riser and not in the production riser, there is no need to have the usual 5 foot minimum radius in the various flow line loops which is required in the conventional system. In my system, the tools can be circulated out merely by reversing the flow, this time down the service line 99 in the production riser bundle through the CCV valve 97 and up the flexible workover riser.

While the above description has been made in detail, various modifications can be made thereto without departing from the spirit or scope of the invention. For example, the flexible workover riser can be lowered from a cantilevered heave supported platform supported off the side of a vessel.

What I claim is:

1. A method of performing operations in a selected subsea well from a platform floating on a body of water over a group of subsea wells which are produced through a production riser means to a production facility on said platform which comprises:

(a) providing a flexible workover riser on said platform, (b) establishing a vertical, flexible workover riser channel through said platform at a location remote from the passage through which said production riser means extends, said riser channel being free of contact with the bottom of said body of water, (c) providing vertical access to a selected tubing of said selected subsea well, (d) running said flexible workover riser through said vertical flexible workover riser channel and into open water below said platform and connecting the lower end of said workover riser to said subsea well to provide access through said flexible workover riser into the production tubing of said well, and (e) conducting operations through said connected flexible workover riser.

2. A method as defined in claim 1 in which Step (e) includes running wireline tools through said workover riser.

3. A method as defined in claim 1 in which a line (57) having a circulating control valve (97) is connected to the service line (99) in the production riser means, the improved method including the step of circulating down through said workover riser through said circulating control valve and up said service line in said production riser means.

4. A method as defined in claim 1 including pumping pump down tools down through said flexible workover riser and later retrieving such tools through said workover riser.

5. A floating production station for use with subsea production wells in which a production riser bundle extends from a subsea production area to a floating vessel which comprises:

a floating platform having a production moon pool through which said production riser means extends;

a rig on and fixed to said platform above said production moon pool;

a flexible workover riser supported by said floating platform;

a vertical flexible workover riser passage in said floating platform removed from said production moon pool;

a work platform provided with a vertical passage therethrough aligned with said vertical flexible workover passage;

heave compensating means supporting said work platform from said floating platform;

means to lower said flexible workover riser through said vertical workover riser passage.

6. A method of performing operations in a selected subsea well from a platform floating over a group of subsea wells which are produced through a production riser means to production facilities on said platform, and including a circulating control valve connected to a service line in said production riser means, which comprises:

(a) providing a flexible workover riser on said platforms, (b) establishing a vertical, flexible workover riser channel supported by said platform at a location remote from the passage through which said production riser means extends, (c) providing vertical access to a selected tubing of said selected subsea well, (d) running said flexible workover riser through said vertical flexible workover riser channel and connecting the lower end of said workover riser to said subsea well to provide access through said flexible workover riser into the production tubing of said well, (e) conducting operation through said connecting flexible workover riser including the step of circulating down through said workover riser through said circulating control valve and up said service line in said production riser means.

7. A method of performing operations in a selected subsea well from a platform floating on a body of water over a group of subsea wells which comprises:

(a) providing a moon pool in said platform, (b) providing a production riser means from said subsea wells through said moon pool to production facilities on said platform, (c) providing a flexible workover riser on said platform, (d) establishing a vertical flexible workover riser, channel through said platform at a location remote from said moon pool, (e) providing vertical access to a tubing in said selected subsea well, (f) running said flexible workover riser through said vertical workover riser channel and out the bottom thereof into open water below said platform, and continuing running said flexible workover riser through open water until it is in the vicinity of said subsea well, (g) thereafter connecting the lower end of said workover riser to said subsea well to provide access through said flexible workover riser into the production tubing of said well, and, (h) conducting operations through said connected flexible workover riser while continuing production through the other wells.

* * * * *